US011059145B2

(12) United States Patent
Okamoto et al.

(10) Patent No.: US 11,059,145 B2
(45) Date of Patent: Jul. 13, 2021

(54) DRESSING APPARATUS AND DRESSING METHOD FOR SUBSTRATE REAR SURFACE POLISHING MEMBER

(71) Applicant: Tokyo Electron Limited, Tokyo (JP)

(72) Inventors: Yoshiki Okamoto, Koshi (JP); Yasushi Takiguchi, Koshi (JP); Akihiro Kubo, Koshi (JP); Hayato Hosaka, Koshi (JP); Ryuto Ozasa, Koshi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 460 days.

(21) Appl. No.: 16/059,344

(22) Filed: Aug. 9, 2018

(65) Prior Publication Data

US 2019/0047118 A1 Feb. 14, 2019

(30) Foreign Application Priority Data

Aug. 10, 2017 (JP) ..... JP2017-155721
May 17, 2018 (JP) ..... JP2018-095095

(51) Int. Cl.

| | |
|---|---|
| ***B24B 53/017*** | (2012.01) |
| ***B24B 37/20*** | (2012.01) |
| ***B24B 37/04*** | (2012.01) |
| ***B24B 53/14*** | (2006.01) |
| ***B24B 37/10*** | (2012.01) |
| ***B24B 27/00*** | (2006.01) |
| ***B24B 49/12*** | (2006.01) |
| ***B24B 53/007*** | (2006.01) |
| ***B24B 53/095*** | (2006.01) |

(52) U.S. Cl.

CPC ..... *B24B 53/017* (2013.01); *B24B 27/0084* (2013.01); *B24B 37/042* (2013.01); *B24B 37/105* (2013.01); *B24B 37/205* (2013.01); *B24B 49/12* (2013.01); *B24B 53/007* (2013.01); *B24B 53/095* (2013.01); *B24B 53/14* (2013.01)

(58) Field of Classification Search

CPC ... B24B 53/017; B24B 53/007; B24B 53/095; B24B 53/14; B24B 27/0084; B24B 37/042; B24B 37/105; B24B 49/12

See application file for complete search history.

(56) References Cited

U.S. PATENT DOCUMENTS 10,840,079 B2 * 11/2020 Takiguchi ..... H01L 21/67288
2016/0099156 A1 * 4/2016 Yamaguchi ..... H01L 21/67248 438/692

FOREIGN PATENT DOCUMENTS

JP 2010-069601 A 4/2010

* cited by examiner

*Primary Examiner* — Dung Van Nguyen
(74) *Attorney, Agent, or Firm* — Pearne & Gordon LLP

(57) ABSTRACT

A dressing apparatus 200 includes a bus member 203 which is equipped with a ceiling plate 201 and a circular or polygonal cylindrical skirt portion 202 provided at a bottom surface of the ceiling plate 201 and which is configured to accommodate a polishing pad 131 from thereabove. The bus member 203 includes a dual fluid nozzle 204 configured to jet a cleaning liquid and a gas onto a polishing surface of the polishing pad 131; a dress board 205 configured to come into contact with the polishing surface of the polishing pad 131; and a rinse nozzle 206 configured to supply a rinse liquid onto a contact surface between the polishing surface of the polishing pad 131 and the dress board 205. A cleaning liquid, a fragment of a grindstone or a sludge is suppressed from being scattered around by the skirt portion 202.

18 Claims, 13 Drawing Sheets

DRESSING APPARATUS AND DRESSING METHOD FOR SUBSTRATE REAR SURFACE POLISHING MEMBER

CROSS-REFERENCE TO RELATED APPLICATION

This application claims the benefit of Japanese Patent Application Nos. 2017-155721 and 2018-095095 filed on Aug. 10, 2017 and May 17, 2018, respectively, the entire disclosures of which are incorporated herein by reference.

TECHNICAL FIELD

The embodiments described herein pertain generally to a dressing apparatus and a dressing method for a substrate rear surface polishing member.

BACKGROUND

In a manufacturing process for a semiconductor device, for example, a polishing processing is performed on a rear surface of a semiconductor wafer (sometimes simply referred to as "wafer" in the following description) with a polishing member such as a polishing pad prior to performing, for example, a pattern exposure processing. This polishing processing is performed to improve flatness of the rear surface of the substrate to remove a processing deformation without causing a defect or contamination.

In the polishing processing using such a polishing member, however, a sludge (cutting scrap) is generated during the polishing processing. If this sludge enters fine holes or grooves of the polishing pad, a polishing performance may be degraded, resulting in a failure to accomplish a required polishing processing.

In view of this problem, cleaning or dressing is performed on the polishing pad to maintain the performance of the polishing pad within an appropriate range.

As an apparatus for performing the cleaning or dressing of the polishing pad, there is proposed a polishing apparatus for a polishing member configured to polish a surface of a wafer from above the wafer (Patent Document 1). This polishing apparatus is equipped with: a dresser board on which a grindstone for dressing is placed; a dresser board supporting mechanism configured to support the dresser board such that the dresser board is movable between an operation position higher than a holding surface of a chuck table configured to hold a substrate and a retreat position lower than the holding surface of the chuck table; and a cleaning fluid jetting device configured to jet a cleaning fluid onto a polishing surface of the polishing pad located above the dresser board.

Patent Document 1: Japanese Patent Laid-open Publication No. 2010-069601

SUMMARY

However, the technique disclosed in the aforementioned Patent Document 1 is directed to the polishing apparatus for the polishing member having the polishing surface facing downwards, and thus cannot be directly applied to dressing of a rear surface polishing member typically having the polishing surface facing upwards. Thus, there is a demand for an apparatus capable of performing the dressing of the rear surface polishing member. Since cleaning and dressing of this kind of polishing member is usually performed while rotating the polishing member, it is important to prevent a sludge or a cleaning liquid from being scattered around.

In view of the foregoing, exemplary embodiments provide a technique capable of appropriately performing cleaning and dressing of a polishing member configured to polish a rear surface of a substrate without causing a cleaning liquid, a sludge or a fragment of a grindstone generated at the time of the dressing from being scattered around.

In one exemplary embodiment, there is provided a dressing apparatus of a substrate rear surface polishing member configured to perform dressing of the polishing member configured to polish a rear surface of a substrate. The dressing apparatus of the substrate rear surface polishing member includes a bus member which is equipped with a ceiling plate and a circular or polygonal cylindrical skirt portion provided at a bottom surface of the ceiling plate and which is configured to accommodate the polishing member from thereabove; a nozzle provided at the bus member and configured to jet a cleaning liquid and a gas onto a polishing surface of the polishing member accommodated in the bus member; and a dressing member provided at the bus member and configured to come into contact with the polishing surface of the polishing member accommodated in the bus member. The dressing apparatus is provided at a position where the dressing apparatus does not overlap with the substrate as a polishing target, when viewed from the top.

According to the present exemplary embodiment, the cleaning and the dressing of the polishing pad is performed in the state that the polishing pad is accommodated in the bus member from thereabove. Therefore, when the cleaning and the dressing are performed while rotating the polishing pad, the cleaning liquid, the fragment of the grindstone or the sludge scattered around collide with an inner side of the skirt portion of the bus member to just drop down without being scattered around the bus member. Further, since the dressing apparatus itself is located at the position where it does not overlap with the substrate as the polishing target when viewed from the top, the dropped cleaning liquid, fragment of the grindstone or sludge does not adhere to the substrate as the rear surface polishing target. Here, the accommodating of the polishing member from thereabove refers to a state in which the lower end of the skirt portion is located at least under the polishing surface of the polishing member.

The dressing apparatus of the substrate rear surface polishing member may include a nozzle configured to supply a rinse liquid onto the polishing surface of the polishing member.

It is desirable that a lower end of the skirt portion is located under a surface of the substrate as the polishing target.

The dressing member has a planar shape (having slight surface roughness required for the polishing) at a side of the polishing surface of the polishing member, and has a shape covering at least a half of the polishing member The dressing member may be configured to be rotated.

The dressing member may have a columnar shape and may be disposed such that a circumferential surface of the dressing member is configured to be contacted with the polishing surface of the polishing member, and the dressing member may be configured to be rotated following up a rotation of the polishing member.

In this case, the dressing member may have a taper shape having different diameters at one end and the other end thereof.

Further, the dressing member may be configured to be rocked centering on a preset supporting point other than an end portion thereof in a lengthwise direction.

The dressing member may be provided at the bus member with an elastic member therebetween.

The dressing member may be provided at the bus member with a universal joint therebetween.

The cleaning liquid may be heated.

The dressing apparatus of the substrate rear surface polishing member may further include an imaging device configured to check the polishing surface of the polishing member. Further, the dressing apparatus of the substrate rear surface polishing member may further include a laser displacement meter configured to check a surface state of the polishing surface of the polishing member. Here, the surface state of the polishing surface may refer to, by way of non-limiting example, a wear amount or contamination of the polishing surface.

In accordance with another exemplary embodiment, there is provided a dressing method of a substrate rear surface polishing member for performing dressing of the polishing member configured to polish a rear surface of a substrate. The dressing method of the substrate rear surface polishing member includes, by using a bus member which is equipped with a ceiling plate and a circular or polygonal cylindrical skirt portion provided at a bottom surface of the ceiling plate and which is configured to accommodate the polishing member from thereabove, at a position where the polishing member does not overlap with a substrate as a polishing target when viewed from the top, performing cleaning by supplying a cleaning liquid onto a polishing surface of the polishing member while rotating the polishing member within the bus member, and performing dressing by bringing a dressing member provided at the bus member into contact with the polishing surface of the polishing member while rotating the polishing member.

In accordance with yet another exemplary embodiment, there is provided a dressing method of a substrate rear surface polishing member for performing dressing of the polishing member configured to polish a rear surface of a substrate. The dressing method of the substrate rear surface polishing member includes, by using a bus member which is equipped with a ceiling plate and a circular or polygonal cylindrical skirt portion provided at a bottom surface of the ceiling plate and which is configured to accommodate the polishing member from thereabove, at a position where the polishing member does not overlap with a substrate as a polishing target when viewed from the top, performing cleaning by supplying a cleaning liquid onto a polishing surface of the polishing member within the bus member, and performing dressing by bringing a dressing member provided at the bus member into contact with the polishing surface of the polishing member while allowing the polishing member to revolve centering on a position other than a center of the polishing member.

In this case, a pressing pressure of the polishing member against the rear surface of the substrate while the rear surface of the substrate is polished may be adjusted within the bus member.

In accordance with still yet another exemplary embodiment, there is provided a dressing method of a substrate rear surface polishing member for performing cleaning and dressing of the polishing member by using the dressing apparatus having the above-described imaging device. The cleaning and the dressing are performed based on the surface state of the polishing surface of the polishing member obtained by the imaging device.

According to the above-described exemplary embodiments, when cleaning and dressing the polishing member configured to polish the rear surface of the substrate, the cleaning liquid or the sludge is not scattered around, and the cleaning liquid, the fragment of the grindstone or the sludge is not scattered to and adhere to the substrate as the rear surface polishing target. Therefore, it is possible to appropriately perform the cleaning and the dressing upon the polishing member which is configured to polish the rear surface of the substrate.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
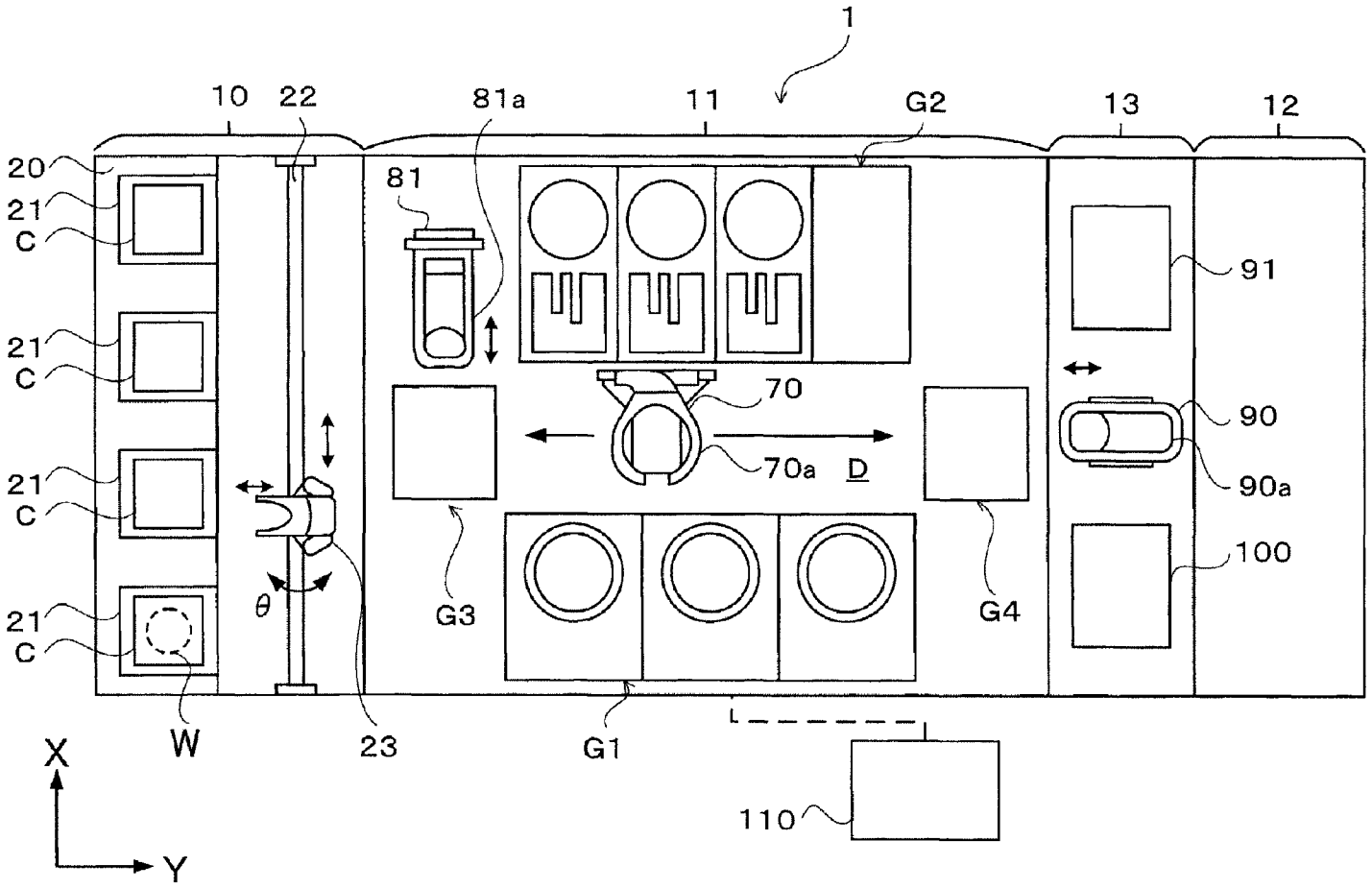
FIG. 1 is a plan view schematically illustrating a substrate processing system equipped with a dressing apparatus according to an exemplary embodiment.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current exemplary embodiment. Still, the exemplary embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Hereinafter, exemplary embodiments will be described with reference to the accompanying drawings. In the specification and the drawings, parts having the substantially same function and configuration will be assigned same reference numerals, and redundant description will be omitted.

<Substrate Processing System>

Figure 2:
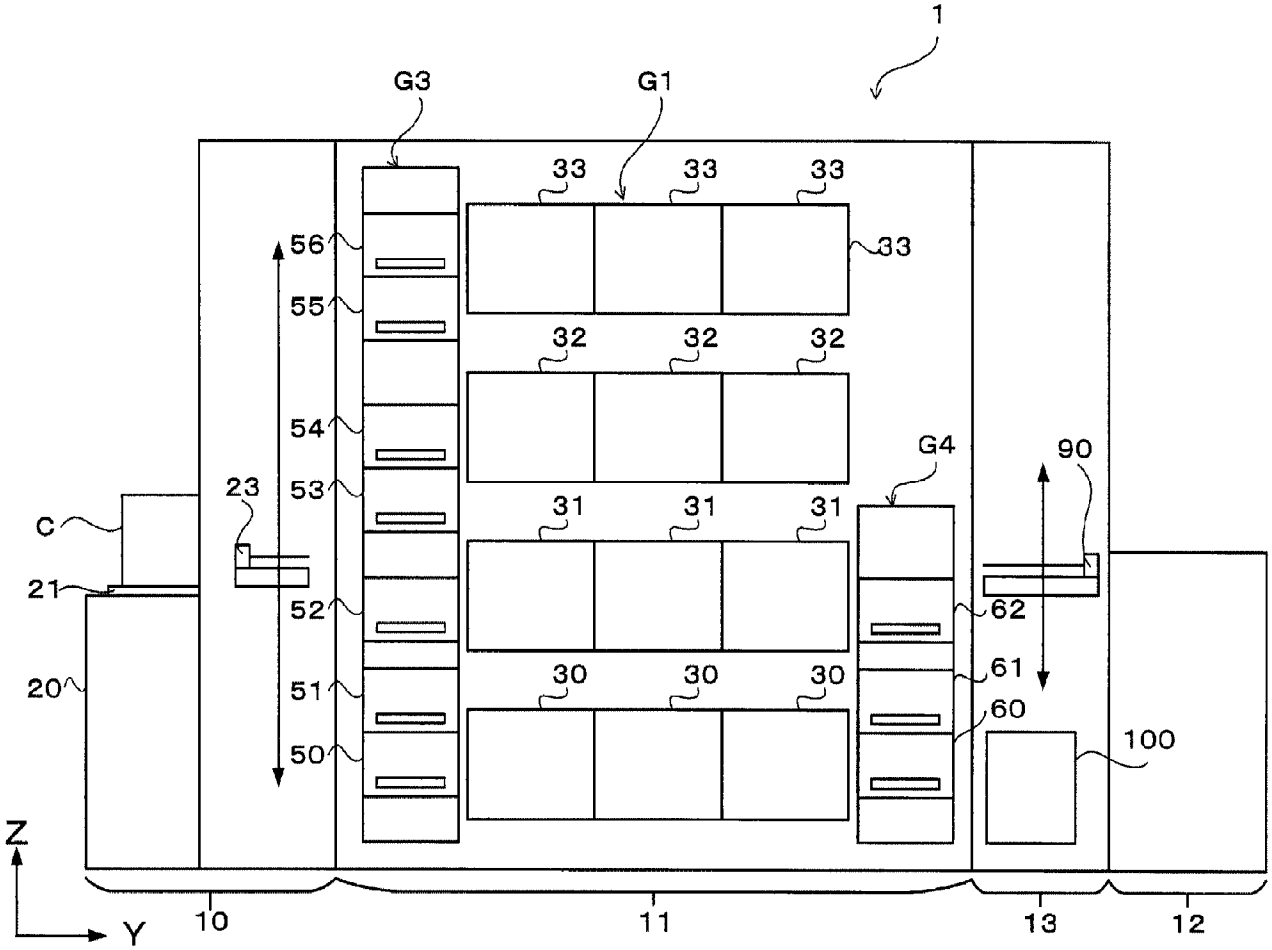
FIG. 2 is a front view of the substrate processing system of FIG. 1.
Figure 3:
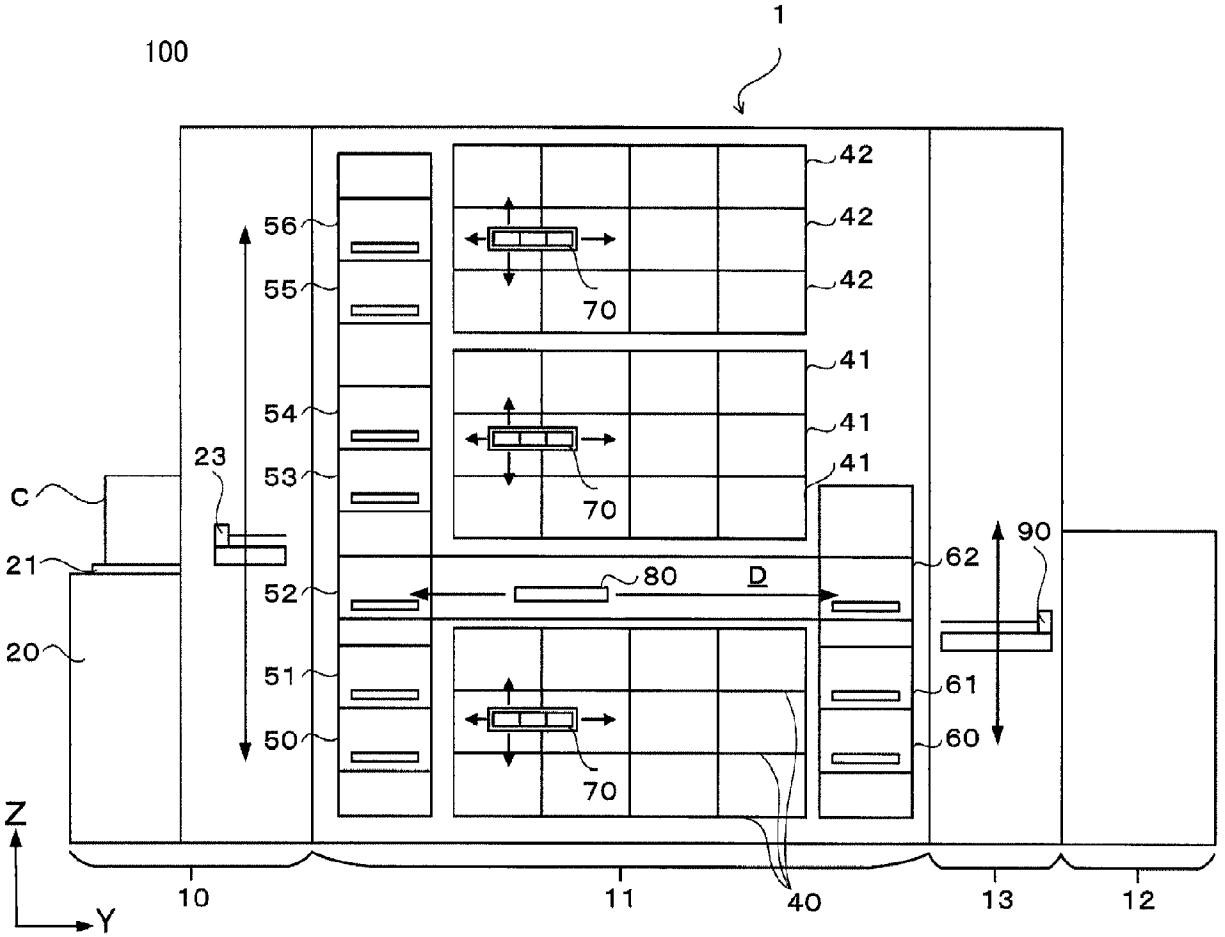
FIG. 3 is a rear view of the substrate processing system of FIG. 1.

First, a configuration of a substrate processing system equipped with a dressing apparatus according to an exemplary embodiment will be explained. FIG. 1 is a plan view schematically illustrating a configuration of a substrate processing system 1. FIG. 2 and FIG. 3 are a front view and a rear view, respectively, illustrating an internal configuration of the substrate processing system 1. In the substrate processing system 1, preset processings are performed on a wafer W as a processing target substrate.

The substrate processing system 1 is equipped with, as depicted in FIG. 1, a cassette station 10 into/from which a cassette C accommodating therein a multiple number of wafers W is carried; a processing station 11 equipped with a plurality of processing apparatuses respectively configured to perform the preset processings on the wafer W; and an interface station 13 configured to transfer the wafer W between the processing station 11 and an exposure apparatus 12 disposed adjacent to the processing station 11. The cassette station 10, the processing station 11 and the interface station 13 are connected as one body.

A cassette placing table 20 is provided in the cassette station 10. The cassette placing table 20 is provided with a plurality of cassette placing plates 21 configured to place thereon cassettes C when the cassettes C are carried to/from the outside of the substrate processing system.

The cassette station 10 is equipped with a wafer transfer device 23 configured to be movable on a transfer path 22 which is extended in the X direction as shown in FIG. 1. The wafer transfer device 23 is also configured to be movable up and down and rotatable around a vertical axis (θ direction) and is capable of transferring the wafers W between the cassette C on each cassette placing plate 21 and a transit device of a third block G3 of the processing station 11 to be described later.

The processing station 11 is provided with a plurality of, for example, four blocks, that is, a first block G1 to a fourth block G4 each of which is equipped with various kinds of apparatuses. By way of example, a second block G2 is provided at a rear side (the positive X-axis side of FIG. 1, upper side of the drawing) of the processing station 11. Further, the aforementioned third block G3 is provided at a side of the cassette station 10 (the negative Y-axis side of FIG. 1) of the processing station 11, and the fourth block G4 is disposed at a side of the interface station 13 (the positive Y-axis side of FIG. 1) of the processing station 11.

By way of example, the first block G1 accommodates therein a plurality of liquid processing apparatuses, as shown in FIG. 2. By way of example, developing apparatuses 30 configured to perform a developing processing on the wafer W, lower antireflection film forming apparatuses 31 configured to form an antireflection film (hereinafter, referred to as "lower antireflection film") under a processing target film of the wafer W, resist coating apparatuses 32 as processing liquid coating apparatuses configured to form the processing target film by coating a resist on the wafer W, and upper antireflection film forming apparatuses 33 configured to form an antireflection film (hereinafter, referred to as "upper antireflection film") on the processing target film of the wafer W are arranged in this sequence from the bottom.

For example, a number of the developing apparatuses 30 is three, and these three developing apparatuses 30 are horizontally arranged. Likewise, a number of the lower antireflection film forming apparatuses 31 is three, and these three lower antireflection film forming apparatuses 31 are arranged horizontally. Further, a number of the resist coating apparatuses 32 is three, and these three resist coating apparatuses 32 are arranged horizontally. Also, a number of the upper antireflection film forming apparatuses 33 is three, and these three upper antireflection film forming apparatuses 33 are arranged horizontally. Here, the numbers of the developing apparatuses 30, the lower antireflection film forming apparatuses 31, the resist film forming apparatuses 32 and the upper antireflection film forming apparatuses 33 and the arrangements thereof may be modified as required.

In each of these developing apparatuses 30, lower antireflection film forming apparatuses 31, resist coating apparatuses 32 and upper antireflection film forming apparatuses 33, spin coating of coating a preset processing liquid on the wafer W is performed, for example. In the spin coating, the processing liquid is discharged onto the wafer W from, for example, a coating nozzle, and the processing liquid is diffused on a surface of the wafer W by rotating the wafer W.

By way of example, within the second block G2, as shown in FIG. 3, heat treatment apparatuses 40 configured to perform a heat treatment such as heating or cooling of the wafer W, hydrophobizing apparatuses 41 configured to perform a hydrophobizing processing to improve adhesivity between the resist liquid and the wafer W, and periphery exposure apparatuses 42 configured to perform exposure to a peripheral portion of the wafer W are arranged in the vertical direction and in the horizontal direction. The numbers and the arrangements of the heat treatment apparatuses 40, the hydrophobizing apparatuses 41 and the periphery exposure apparatuses 42 may be modified as required.

By way of example, within the third block G3, a multiple number of transit devices 50, 51, 52, 53, 54, 55 and 56 are arranged in sequence from the bottom. Further, within the fourth block G4, a plurality of transit devices 60, 61 and 62 are arranged in sequence from the bottom.

As depicted in FIG. 1, a wafer transfer region D is formed in an area surrounded by the first block G1 to the fourth block G4. Multiple wafer transfer devices 70 each of which has a transfer arm 70*a* configured to be movable in the Y, X, θ and up-and-down directions are disposed within the wafer transfer region D. The wafer transfer devices 70 are moved within the wafer transfer region D and capable of moving the wafers W to preset apparatuses within the first to fourth blocks G1 to G4.

Further, also provided in the wafer transfer region D is a shuttle transfer device 80 which is configured to transfer the wafer W between the third block G3 and the fourth block G4 linearly as illustrated in FIG. 3.

By way of example, the shuttle transfer device 80 is configured to be movable linearly in the Y direction of FIG. 3. The shuttle transfer device 80 is capable of transferring the wafer W between the transit device 52 of the third block G3 and the transit device 62 of the fourth block G4 by being moved in the Y direction while holding the wafer W.

As depicted in FIG. 1, a wafer transfer device 81 is provided at the positive X-axis side of the third block G3. The wafer transfer device 81 is equipped with a transfer arm 81*a* configured to be movable in the X, θ and up-and-down directions. The wafer transfer device 81 is capable of transferring the wafer W into the transit devices within the third block G3 by being moved up and down while holding the wafer W with the transfer arm 81*a*.

The interface station 13 accommodates therein a wafer transfer device 90, a transit device 91 and a rear surface polishing apparatus 100 for the substrate to be described later. For example, the wafer transfer device 90 is equipped with a transfer arm 90*a* configured to be movable in the Y, θ and up-and-down directions. The wafer transfer device 90 is capable of transferring the wafer W between each transit device within the fourth block G4, the transit device 91, the rear surface polishing apparatus 100 and the exposure apparatus 12 while holding the wafer W with the transfer arm 90*a*, for example.

The above-described substrate processing system 1 includes a control unit 110, as illustrated in FIG. 1. The control unit 110 is implemented by, for example, a computer and equipped with a program storage unit (not shown). The program storage unit stores therein a program for controlling a processing on the wafer W within the substrate processing system 1. Further, the program may be recorded in a computer-readable recording medium such as a hard disk (HD), a flexible disk (FD), a compact disk (CD), a magnet optical disk (MO) or a memory card and may be installed to the control unit 110 from this recording medium.

<Rear Surface Polishing Apparatus 100>

Now, a configuration of the rear surface polishing apparatus 100 for the substrate including a dressing apparatus according to the exemplary embodiment will be discussed.

Figure 4:
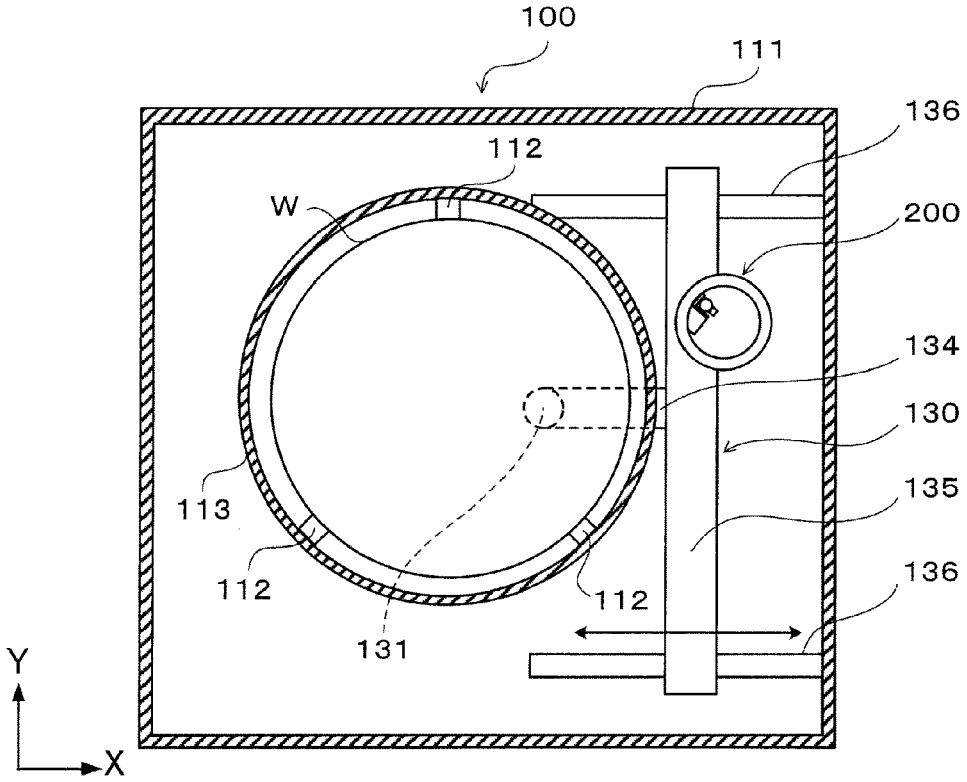
FIG. 4 is a plan view illustrating a schematic configuration of a rear surface polishing apparatus equipped with the dressing apparatus according to the exemplary embodiment.
Figure 5:
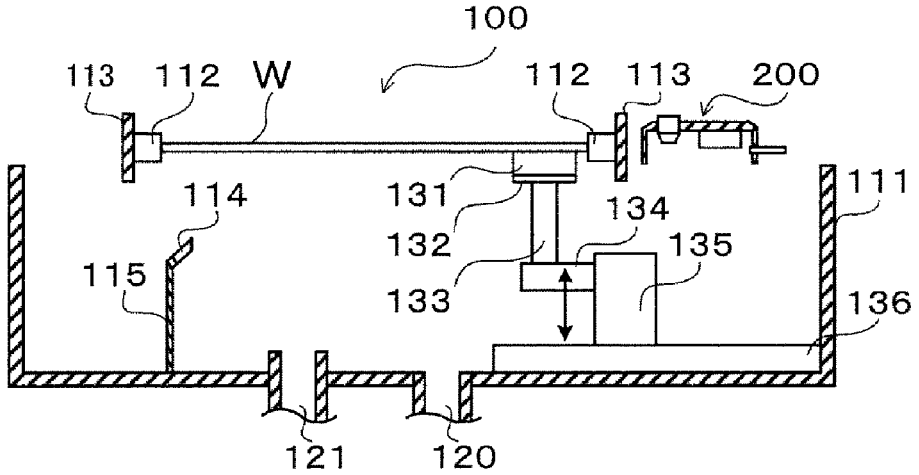
FIG. 5 is a front view of the rear surface polishing apparatus of FIG. 4.

FIG. 4 is a plan view illustrating a schematic configuration of the rear surface polishing apparatus 100, and FIG. 5 is a side view schematically illustrating the configuration of the rear surface polishing apparatus 100.

In the rear surface polishing apparatus 100, holding members 112 configured to hold the wafer W as a polishing target horizontally are provided at, for example, three positions within a housing 111 having an open top. These holding members 112 are provided at an inner periphery of a ring member 113, which is disposed within the housing 111 and configured to be rotatable. The holding members 112 are capable of pressing a peripheral portion of the wafer W by being moved toward a center of the wafer W through a holding member driving mechanism (not shown) provided at the ring member 113. The holding members 112 are capable of holding the wafer W horizontally while pressing them. As the ring member 113 is rotated, the wafer W held thereby is also rotated.

A nozzle 114 configured to jet a cleaning liquid to a rear surface of the wafer W held by the holding members 112 is provided at a bottom portion of the housing 111 with a supporting body 115 therebetween.

Further, also provided at the bottom portion of the housing 111 are a drain pipe 120 through which the cleaning liquid or the like is drained and an exhaust pipe 121 which is configured to create a downflow air current within the housing 111 of the rear surface polishing apparatus 100 and through which this downflow air current is exhausted.

<Polishing Device 130>

A polishing device 130 configured to polish the rear surface of the wafer W held by the holding members 112 horizontally is provided within the housing 111. In the polishing device 130, a polishing pad 131 as a polishing member configured to be brought into contact with the wafer W when rear surface polishing of the wafer W is performed is fixed to a top surface of a supporting body 132.

The supporting body 132 is provided on top of a rotatable supporting column 133, and the supporting column 133 is provided at a horizontally extended supporting arm 134. The supporting arm 134 is provided at a driving mechanism 135 extended in the Y direction within the housing 111, and is movable in the Y direction along a lengthwise direction of the driving mechanism 135. Further, the supporting arm 134 is also configured to be movable up and down. The driving mechanism 135 is movable in the X direction along a rail 136 which is provided at the bottom portion of the housing 111 along the X direction. With this configuration, the polishing pad 131 is configured to be movable three dimensionally within the housing 111.

<Dressing Apparatus 200>

As depicted in FIG. 4, the dressing apparatus 200 according to the exemplary embodiment is provided within the housing 111 while being separated from the wafer W in order not to be overlapped with the wafer W held by the holding members 112 when viewed from the top.

Figure 6:
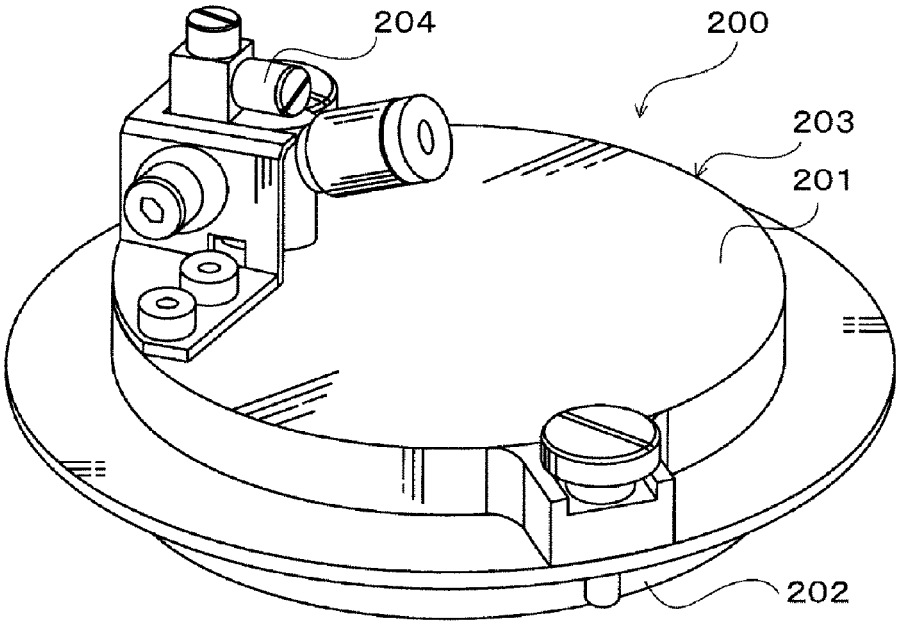
FIG. 6 is a perspective view of the dressing apparatus according to the exemplary embodiment.
Figure 7:
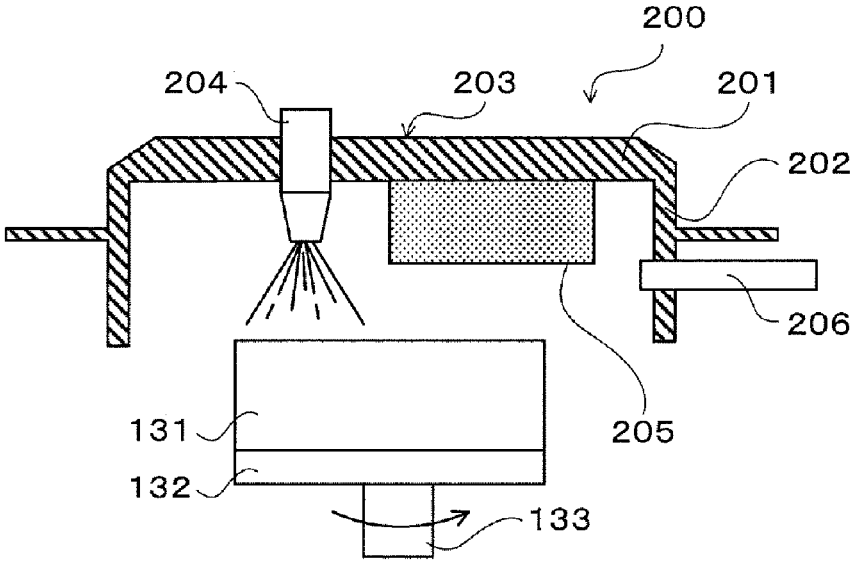
FIG. 7 is a side view schematically illustrating the inside of the dressing apparatus according to the exemplary embodiment.
Figure 8:
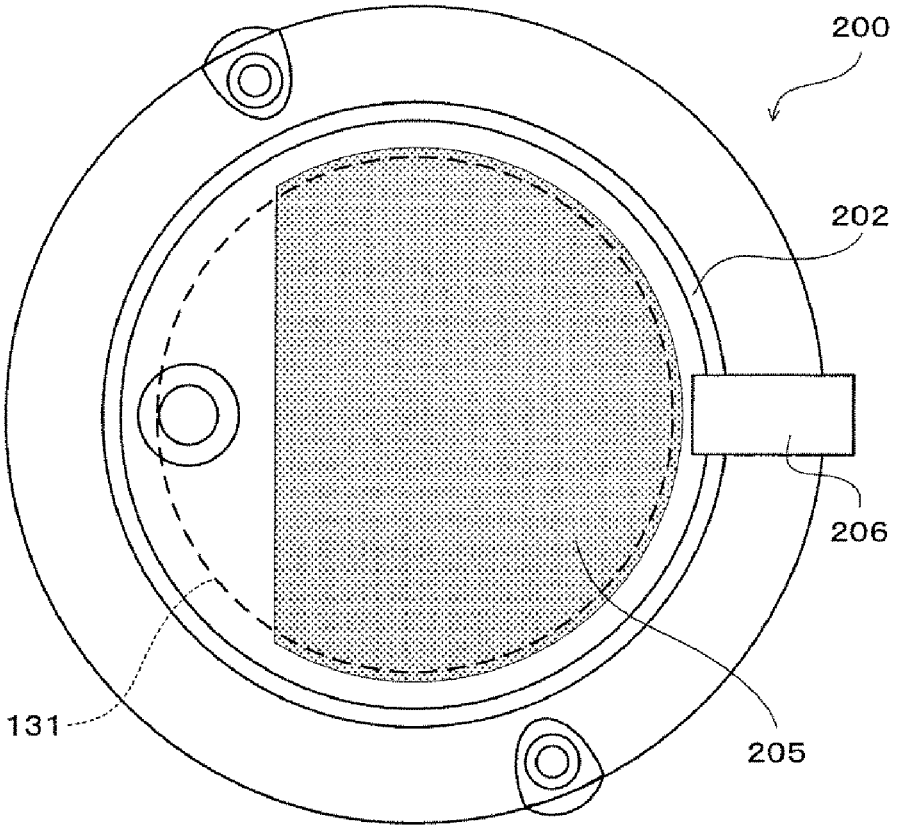
FIG. 8 is a bottom view of the dressing apparatus according to the exemplary embodiment.

FIG. 6 is a perspective view of the dressing apparatus 200, and FIG. 7 and FIG. 8 are a front view and a bottom view, respectively, illustrating a schematic configuration of the dressing apparatus 200.

As depicted in FIG. 6 to FIG. 8, the dressing apparatus 200 includes a ceiling plate 201 and a circular or polygonal cylindrical skirt portion 202 provided at a bottom surface of the ceiling plate 201. The ceiling plate 201 and the skirt portion 202 constitute a bus member 203. The skirt portion 202 has an inner diameter and a vertical length set to allow the polishing pad 131 to be accommodated inside the skirt portion 202.

The ceiling plate 201 is provided with a dual fluid nozzle 204 configured to penetrate the ceiling plate 201 and jet a gas and a cleaning liquid into the bus member 203 at the same time. Further, a dress board 205 as a dressing member configured to perform the dressing on the polishing pad 131 is provided at an inner bottom surface of the ceiling plate 201. The dress board 205 has a disk shape a part of which is cut straightly, as shown in FIG. 8, and has a size covering at least a half of the polishing pad 131.

Further, the skirt portion 202 is provided with a rinse nozzle 206 configured to supply a rinse liquid in the horizontal direction at a bottom surface side of the dress board 205.

The dressing apparatus 200 according to the exemplary embodiment has the above-described configuration, and, now, a dressing method using this dressing apparatus 200 will be explained.

<Dressing Method>

Cleaning and dressing of the polishing pad 131 using the dressing apparatus 200 are performed as follows, for example. First, the supporting column 133 is located under the bus member 203. Then, by raising the supporting column 133, a polishing surface of the polishing pad 131 is accommodated within the bus member 203, as depicted in FIG. 7. In this state, while rotating the polishing pad 131, a gas, for example, a nitrogen gas and a cleaning liquid, for example, pure water are jetted from the dual fluid nozzle 204 toward the polishing surface as a top surface of the polishing pad 131 in a spray state. As a result, the polishing surface of the polishing pad 131 is cleaned.

Figure 9:
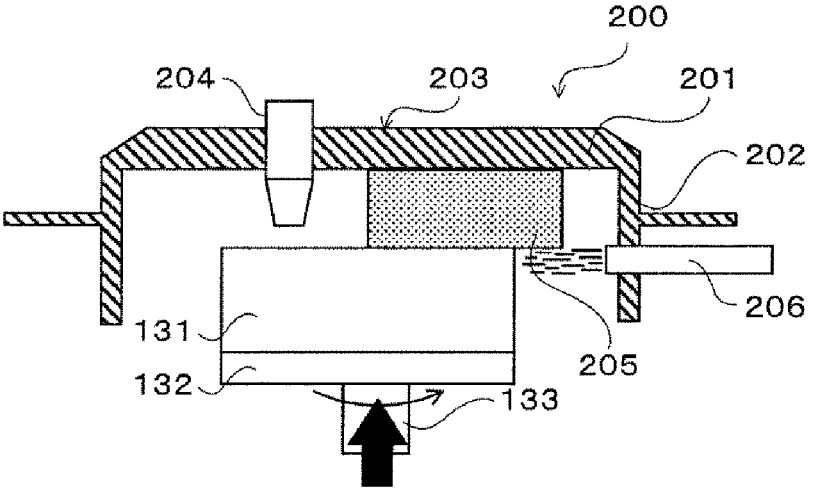
FIG. 9 is a front view schematically illustrating the inside of the dressing apparatus according to the exemplary embodiment while a dressing processing is performed by the dressing apparatus.

Further, in order to perform the dressing of the polishing pad 131, as shown in FIG. 9, the polishing pad 131 is further raised so that the polishing surface of the polishing pad 131 is brought into contact with the dress board 205 and pressed against the dress board 205 at a preset pressure. In this state, by rotating the polishing pad 131 while supplying a rinse liquid from the rinse nozzle 206 toward a contact surface between the polishing surface of the polishing pad 131 and the dress board 205, the dressing of the polishing pad 131 can be performed.

As stated above, according to the dressing method using the dressing apparatus 200 of the exemplary embodiment, the cleaning and the dressing of the polishing pad 131 can be performed in the state that the polishing surface of the polishing pad 131 is accommodated in the bus member 230 having an open bottom. Therefore, when the cleaning and the dressing are performed while rotating the polishing pad 131, the cleaning liquid, the fragment of the grindstone or the sludge scattered around collide with an inner side of the skirt portion 202 of the bus member 203 to just drop down without being scattered to the outside of the bus member 203. Further, since the dressing apparatus 200 itself is located at the position where it does not overlap with the wafer W as the polishing target when viewed from the top, the dropped cleaning liquid, fragment of the grindstone or sludge does not adhere to the wafer W as the rear surface polishing target. Furthermore, by locating a lower end of the skirt portion 202 under the surface of the wafer W, the scattering and the adhesion of the cleaning liquid, the fragment of the grindstone or the sludge to the wafer W can be suppressed more securely.

In addition, the cleaning liquid, the fragment of the grindstone or the sludge dropped from the bus member 203 are drained through the drain pipe 120 provided at the bottom portion of the housing 111. To suppress contamination of an atmosphere within the housing 111 more effectively, it may be possible to provide a drain pan under the bus member 203, thus allowing the cleaning liquid, the fragment of the grindstone or the sludge to be first received by this drain pan and then drained from the housing 111.

Further, during the dressing processing, the rinse liquid is supplied to the polishing surface of the polishing pad 131 from the rinse nozzle 206. However, the rinse liquid or the cleaning liquid may be supplied from the dual fluid nozzle 204. In this case, the rinse nozzle 206 may not be provided.

Figure 10:
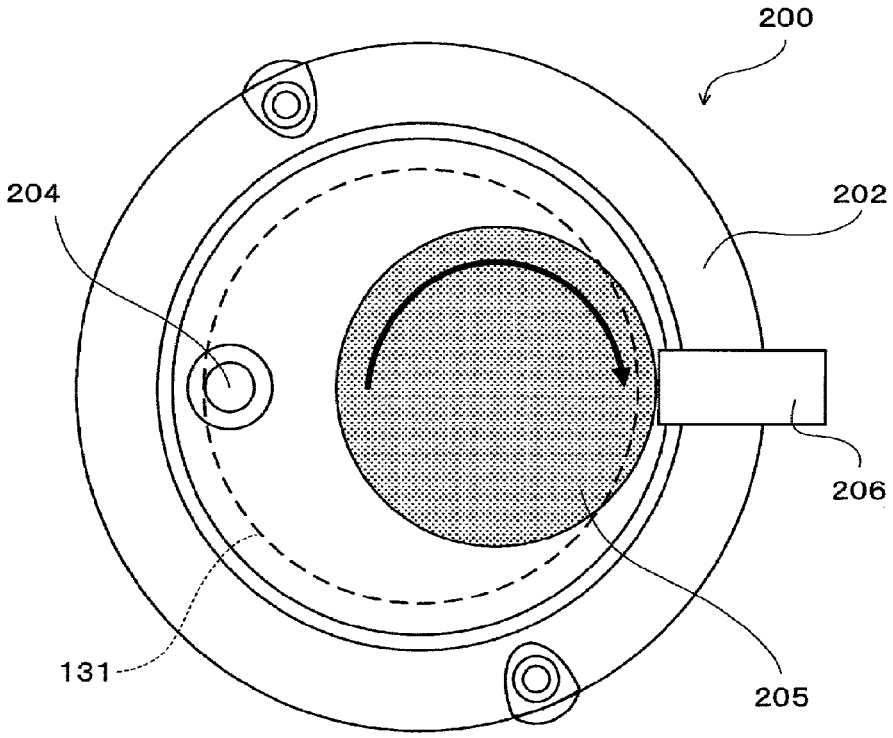
FIG. 10 is a bottom view of the dressing apparatus in which a dress board is configured to be rotated.

Moreover, as illustrated in FIG. 10, the dress board 205 may have a circular shape, and this dress board 205 may be rotated. In this case, the dressing can be carried out more effectively.

Additionally, although the pure water is used as the cleaning liquid in the above-described exemplary embodiment, the cleaning liquid is not limited thereto. Further, by using a heated cleaning liquid, the cleaning effect can be further improved.

When polishing the rear surface of the wafer by the polishing pad 131, it is required to regulate a pressing pressure to a preset value. In the dressing apparatus 200 according to the exemplary embodiment, by setting a bottom surface of the dress board 205 to be level with the rear surface of the wafer W, the pressing pressure can be checked and adjusted in advance. This is called "pressing pressure correction".

Figure 11:
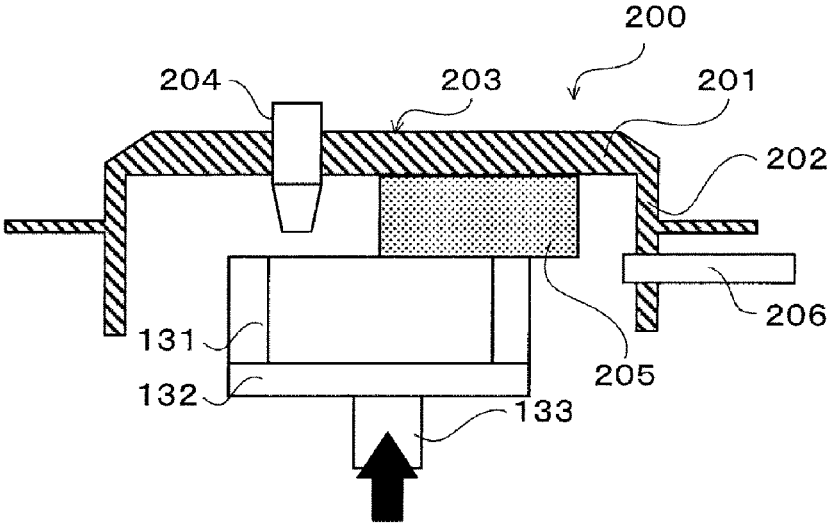
FIG. 11 is a side view schematically illustrating the inside of the dressing apparatus according to the exemplary embodiment when pressing pressure correction is performed by the dressing apparatus.

That is, as shown in FIG. 11, the rotation of the polishing pad 131 is stopped, and the supply of the rinse liquid and the injection from the dual fluid nozzle 204 are stopped. In this state, the polishing pad 131 is raised to be pressed against the dress board 205. In this way, the pressing pressure can be adjusted. Further, to adjust the pressing pressure appropriately, it may be desirable to provide a proper pressure sensor at the dress board 205, for example.

Examples of a sequence of the polishing of the wafer W, the cleaning, the dressing and the pressing pressure correction using the above-described dressing apparatus 200 will be explained.

SEQUENCE EXAMPLE 1

First, prior to performing the rear surface polishing on a first single sheet of wafer W in a lot of wafers W as the rear surface polishing target, the polishing pad 131 is moved to the dressing apparatus 200. Then, the pressing pressure on the rear surface of the wafer W is adjusted. Then, the polishing pad 131 having the corrected pressing pressure is moved to the rear surface polishing apparatus 100, and the rear surface polishing of the wafer W is performed. Then, upon the completion of the rear surface polishing of the wafer W, the polishing pad 131 is moved to the dressing apparatus 200, and the dressing and the cleaning of the polishing pad is performed. This sequence is an example where the dressing and the cleaning are performed whenever the polishing of the single wafer W is completed. Particularly, this sequence is useful in case that the sludge enters the fine holes of the polishing surface of the polishing pad 131 even when the polishing processing is performed only a single time, resulting in the significant deterioration of the performance.

SEQUENCE EXAMPLE 2

First, prior to performing the rear surface polishing on the first single sheet of wafer W in a lot of wafers W as the rear surface polishing target, the polishing pad 131 is moved to the dressing apparatus 200. Then, the pressing pressure on the rear surface of the wafer W is adjusted. Then, the polishing pad 131 having the corrected pressing pressure is moved to the rear surface polishing apparatus 100, and the rear surface polishing of the wafer W is performed. Then, upon the completion of the rear surface polishing of the wafer W, the polishing pad 131 is moved to the dressing apparatus 200, and only the cleaning is performed. Upon the completion of the cleaning, the polishing pad 131 is moved to the rear surface polishing apparatus 100, and the rear surface polishing of a next wafer W is performed. In this way, only the cleaning is performed after the rear surface polishing processing until a number of polished wafers reaches a preset number. If the number of the polished wafers reaches the preset number, both the dressing and the cleaning are performed. This sequence is useful when applied to a case where the preset polishing processing can be performed without suffering any considerable degradation in the performance of the polishing pad 131 even after the polishing processing is performed a single time.

As stated above, determination upon whether both the dressing and the cleaning of the polishing pad 131 will be performed every time the rear surface polishing is performed or only the cleaning will be performed until the number of the polished wafers reaches the preset number may be made based on, for example, an imaging result of the polishing pad 131. That is, a camera configured to image the polishing surface of the polishing pad 131 may be provided within the dressing apparatus 200, for example, and the determination may be made based on a grey scale or RGB data of an image of a surface state of the polishing surface of the polishing pad 131 obtained by the camera.

Further, accuracy of assembly of the individual components of the dressing apparatus 200 may affect the dressing performance. However, to perform the dressing of the polishing pad 131 properly without being affected by, if any, a slight degree of non-uniformity in the assembly, the dress board 205 may be provided at the ceiling plate 201 with an elastic member such as a spring therebetween.

Furthermore, in the above-described exemplary embodiment, the dress board 205 has the disk shape a part of which is cut straightly, and this dress board 205 is fixed to the bottom surface of the ceiling plate 201. Instead, however, a rod-shaped dressing member having a columnar shape may be used.

Figure 12:
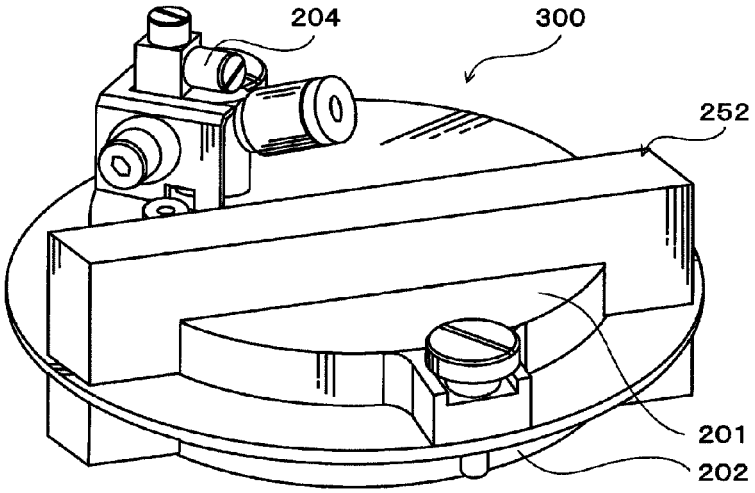
FIG. 12 is a perspective view of a dressing apparatus having a rod-shaped dressing member.
Figure 13:
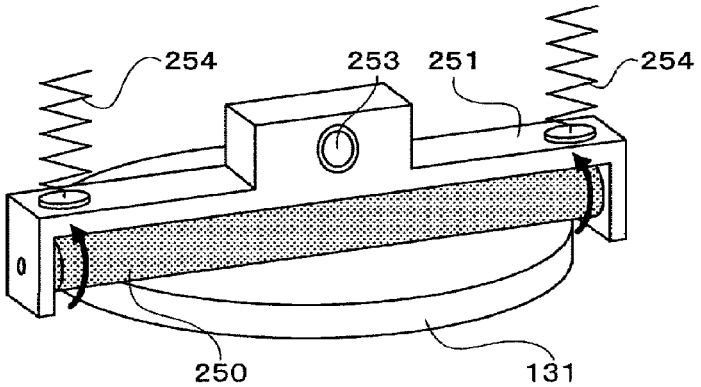
FIG. 13 is a perspective view illustrating a state in which a dressing processing is performed by the rod-shaped dressing member.
Figure 14:
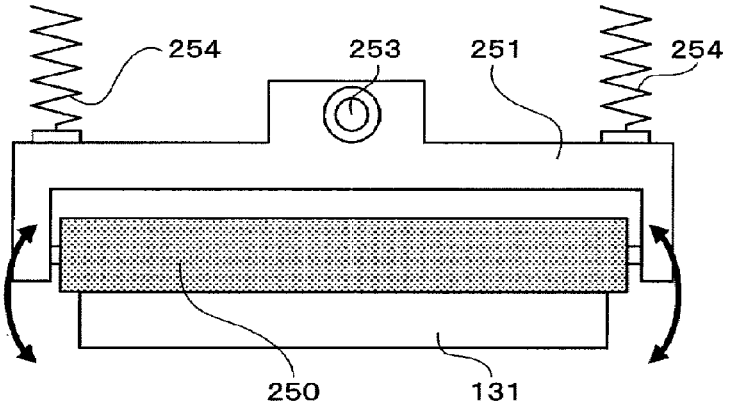
FIG. 14 is a front view of a supporting member, showing a configuration in which the rod-shaped dressing member is rockable.

FIG. 12 to FIG. 14 illustrate a dressing apparatus 300 using a dressing member 250 having a columnar shape. FIG. 12 is a perspective view, and FIG. 13 and FIG. 14 are a perspective view and a front view, respectively, illustrating the dressing member 250 within the bus member 203.

In this example, the dressing member 250 is located on a diameter of the polishing pad 131 and has a length longer than the diameter of the polishing pad 131. The dressing member 250, however, need not necessarily have such a length longer than the diameter of the polishing pad and may have a length reaching at least a center of the polishing pad 131 as long as it is located on the diameter of the polishing pad 131. The dressing member 250 is fastened to a supporting member 251 shown in FIG. 13 to be rotated centering on a central axis thereof. The supporting member 251 is mounted to an inner bottom surface, within the bus member 203, of a mounting member 252 provided at the ceiling plate 201 with a supporting shaft 253 therebetween. The supporting member 251 is configured to be rocked centering on this supporting shaft 253 as a supporting point. Further, one ends of springs 254 are respectively fixed to both ends of the supporting member 251, and the other ends of the springs 254 are respectively fixed to the mounting member 252.

This rod-shaped dressing member 250 is rockable with the supporting shaft 253 as the supporting point, as illustrated in FIG. 14. Thus, even if there is the non-uniformity in the assembly of the components of the dressing apparatus 200 as stated above or even if the polishing pad 131 is shaken due to vibration or the like, the dressing member 250 can always be made to be in contact with the polishing surface of the polishing pad 131 while following up the above. Further, the springs 254 may not be necessarily required.

Figure 15:
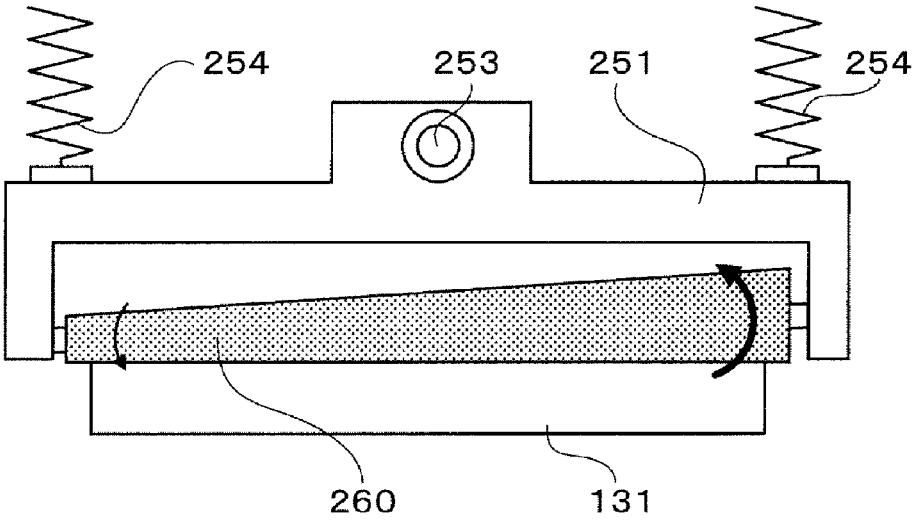
FIG. 15 is a front view of a supporting member configured to support the rod-shaped dressing member having a taper shape.

As for such a rod-shaped dressing member 250, there may be adopted a dressing member 260 having a taper shape with different diameters at one end and the other end thereof, as illustrated in FIG. 15. With this dressing member 260 having the taper shape, it is also possible to perform the dressing of the polishing surface of the polishing pad 131 while successfully following up the polishing surface of the polishing pad 131.

That is, by forming the dressing member 260 to have the taper shape, there can be generated a difference in a torque received by the dressing member 260 through the rotation of the polishing pad 131. Thus, even when a force applied to both ends of the dressing member 260 through the rotation of the polishing pad 131 is same, a torque becomes larger at a side where a distance from the supporting member 251 to a dressing surface of the dressing member 260 is longer, that is, a diameter is longer. Accordingly, the rotation of the dressing member 260 can be carried out appropriately.

Further, in the aforementioned rod-shaped dressing members 250 and 260, the lengths of the dressing members 250 and 260 are set to be longer than the diameter of the polishing pad 131. However, the lengths of the dressing members 250 and 260 may be set to be longer than a radius of the polishing pad 131.

<Dressing Apparatus Having Universal Joint>

Now, a dressing apparatus according to another exemplary embodiment will be explained. A dressing apparatus 400 depicted in a perspective view of FIG. 16 and a bottom view of FIG. 17 shows an example where the dress board 205 is provided at the bus member 203 with a universal joint therebetween.

Figure 18:
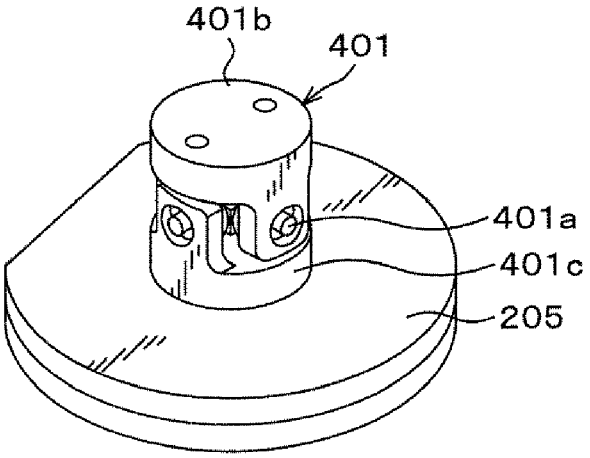
FIG. 18 is a perspective view of the universal joint provided in the dressing apparatus of FIG. 16.

In this example, the dress board 205 is fixed to the ceiling plate 201 of the bus member 203 with a universal joint 401 therebetween, as illustrated in FIG. 18. Although this universal joint 401 adopts a cardan joint configuration using a cross spider 401*a* having a cross shape, a shaft such as a drive shaft and a driven shaft need not be rotated, and it is only required to adopt a configuration in which an angular variation caused by the inclination or the vibration of the dress board 205 can be absorbed. In this example, the ceiling plate 201 is fixed to a fixing portion 401*b* corresponding to one axis of the universal joint, and a fixing portion 401*c* corresponding to the other axis is fixed to a top surface of the dress board 205.

Figure 19A:
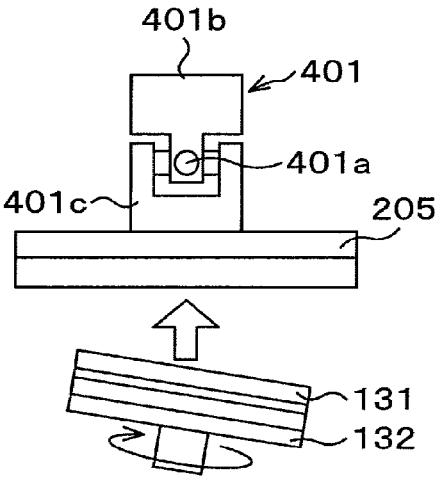
FIG. 19A and FIG. 19B are diagrams illustrating a state in which a dress board is inclined, following up a polishing pad in the dressing apparatus of FIG. 16.
Figure 19B:
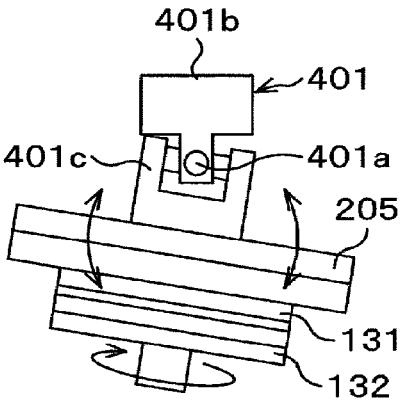

According to the dressing apparatus 400 having this configuration, even if the polishing pad 131 is tilted, as shown in FIG. 19A, the angular variation caused by the inclination or the vibration of the dress board 205 can be absorbed as the dress board 205 is fixed to the ceiling plate 201 of the bus member 203 with the universal joint 401 therebetween as stated above. Accordingly, as depicted in FIG. 19B, even if the polishing pad 131 is inclined for some reasons related to the assembly of the apparatus, the dress board 205 can be also inclined following the polishing pad 131, so that the bottom surface of the dress board 205 can always be brought into uniform contact with the entire surface of the polishing pad 131, so that a required dressing processing can be performed.

Further, according to the dressing apparatus 400 having the above-described configuration, a repulsive force does not change depending on a portion involved or due to a displacement, unlike an elastic body such as a sponge. Therefore, a uniform surface pressure can always be obtained. Further, as compared to a rubber or a sponge, there may be no degradation with a lapse of time or no individual difference. In addition, precise position adjustment between the dress board 205 and the polishing pad 131 is also enabled.

<Dressing Apparatus Having Laser Displacement Meter>

Figure 16:
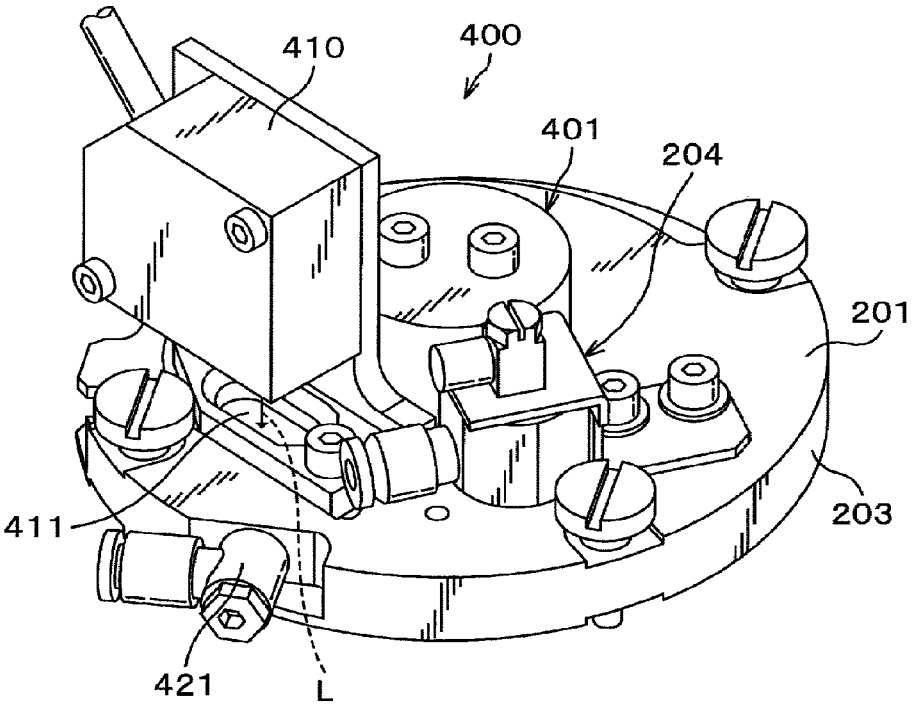
FIG. 16 is a perspective view illustrating a dressing apparatus having a universal joint and a laser displacement meter.
Figure 17:
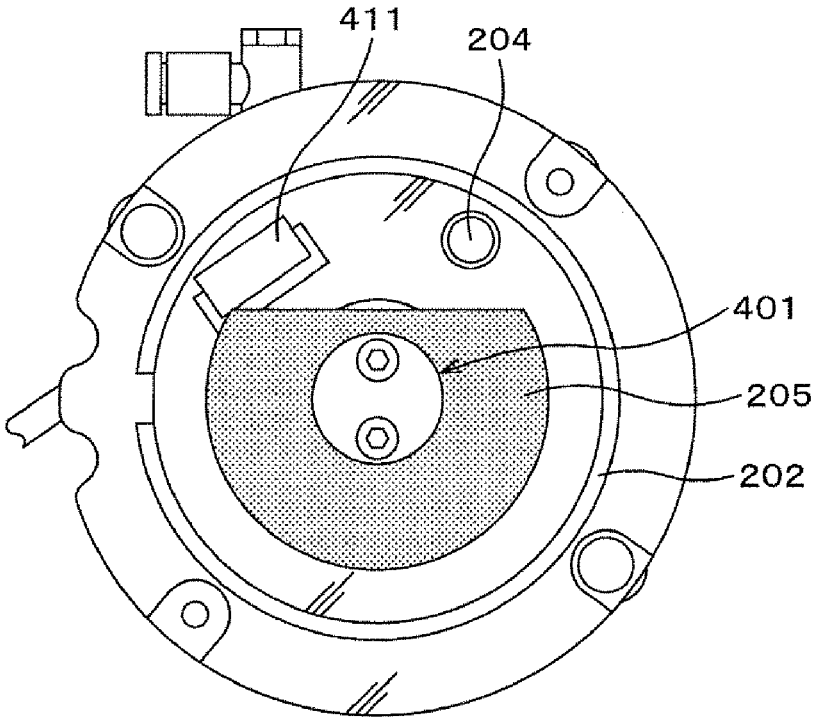
FIG. 17 is a bottom view of the dressing apparatus of FIG. 16.
Figure 20:
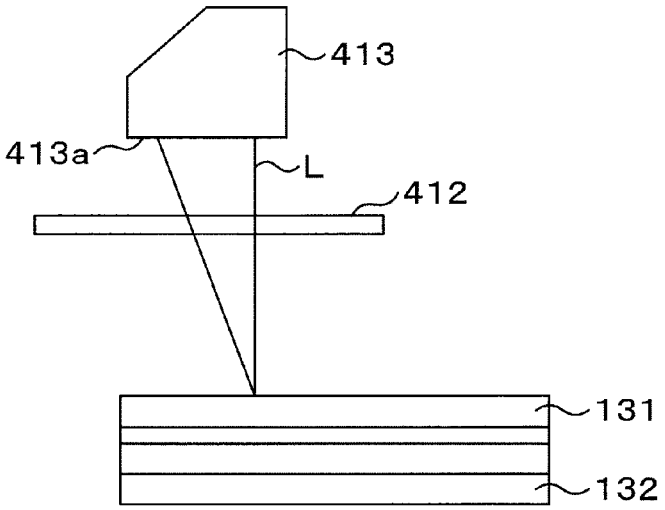
FIG. 20 is a diagram illustrating a state in which measurement is conducted by the laser displacement meter.

The dressing apparatus 400 shown in FIG. 16 is further equipped with a laser displacement meter 410 in addition to the aforementioned universal joint 401. This laser displacement meter 410 is configured to detect a wear amount of a grindstone portion on the surface (top surface) of the polishing pad 131 by irradiating a laser beam L to the surface of the polishing pad 131 located within the bus member 203 of the dressing apparatus 400 through a window 411 formed at the ceiling plate 201. The window 411 is provided with a window member 412 made of a light-transmissive material such as a transparent acryl plate or a glass plate, as shown in FIG. 20. This window member 412 suppresses the cleaning liquid during the dressing processing from adhering to an irradiation surface 413*a* of a laser irradiation unit 413.

Since the wear amount of the grindstone portion of the surface (top surface) of the polishing pad 131 can be detected by the laser beam L from the laser displacement meter 410, the polishing pad 131 can be replaced at proper time. Further, as for the timing for performing the measurement of the wear amount of the grindstone portion of the surface (top surface) of the polishing pad 131 by the laser displacement meter 410, it may be desirable to perform the measurement after the dressing is completed, for example. At this time, since the cleaning liquid in the rinsing processing remains on the surface of the polishing pad 131, it may be desirable to remove water on the surface of the polishing pad 131 when performing the measurement by the laser displacement meter 410.

In this case, like the dressing apparatus 200, the dressing apparatus 400 is equipped with the dual flow nozzle 204 configured to jet the gas and the cleaning liquid into the bus member 203 at the same time. Thus, by jetting only the gas onto the surface of the polishing pad 131, the water on the surface of the polishing pad 131 can be easily removed. Accordingly, a thickness of the grindstone portion of the surface of the polishing pad 131 can be measured accurately, so that the wear amount can be detected with high accuracy.

Further, as a result of performing the detection by actually using this kind of laser displacement meter, a difference in a detection distance is observed between the polishing pad obtained after the surface of the grindstone is cleaned and the polishing pad having a changed color by being apparently contaminated when viewed with naked eyes. Since the difference is larger than an error of the laser displacement meter and is too large to be regarded an influence caused by being clogged with a foreign substance (a difference of about 0.3 mm is observed from the measurement results), it is deemed to be affected by a difference in a color of the surface as well. In this regard, based on, for example, data relating the contamination degree and the measurement result, the contamination degree can be detected. Further, by comparing the measurement results in the same process such as before the polishing processing and after the cleaning processing or after the dressing processing, whether the determined polishing pad or not can be judged.

Further, in case of measuring the thickness of the grindstone portion on the surface of the polishing pad 131 by the laser displacement meter 410, a profile reflecting one-sided wear within the surface of the polishing pad 131 in a circumferential direction can be obtained by performing the measurement along with the rotation of the polishing pad 131. Accordingly, a surface state of the polishing pad 131 can be estimated and managed appropriately. In this case, by considering the aforementioned contamination degree as well, the surface state of the polishing pad 131 can be investigated more accurately.

Figure 21:
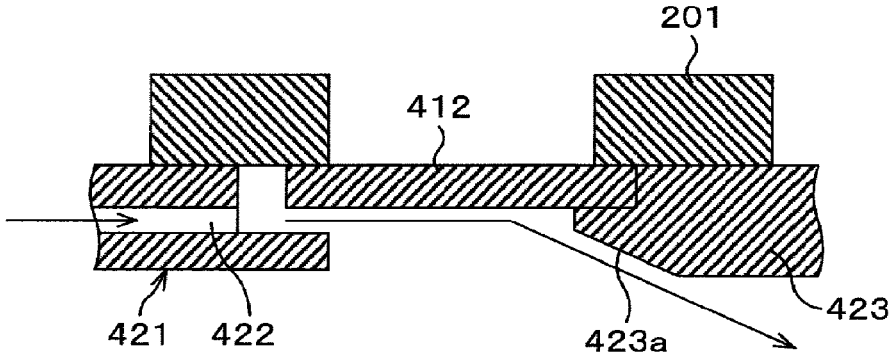
FIG. 21 is a diagram illustrating a state in which air is jetted to a window member.

Meanwhile, there is a likelihood that the cleaning liquid in the dressing processing may adhere to a bottom surface of the window member 412 of the window 411. As a countermeasure, the dressing apparatus 400 is provided with a gas nozzle 421 configured to jet a gas to the bottom surface of the window member 412, as illustrated in FIG. 16 and FIG. 21. Accordingly, the gas jetted from a discharge opening 422 of the gas nozzle 421 can blow water droplets of the cleaning liquid adhering to the bottom surface of the window member 412, as shown in FIG. 21. Thus, adverse influence from the water droplets adhering to the window member 412 or the like upon the measurement can be suppressed.

Furthermore, as depicted in FIG. 21, in the dressing apparatus 400, a guide member 423 having an inclined surface 423*a* is provided at a side facing the discharge opening 422 of the gas nozzle 421. The guide member 423 is configured to guide the gas (e.g., air) jetted from the discharge opening 422 of the gas nozzle 421 downwards along the inclination. Accordingly, the water droplets blown by the gas can be suppressed from re-adhering to the window member 412 by colliding with and being reflected by another member such as the bus member 203.

<Revolution Dressing>

In the above-described dressing apparatuses 200 and 400, the polishing pad 131 itself is supported by the rotatable supporting column 133 with the supporting body 132 therebetween, and while performing the dressing by bringing the polishing pad 131 into contact with the dress board 205, the polishing pad 131 itself is rotated centering on the supporting column 133. In this so-called rotation type dressing method for the polishing pad 131, although the dressing itself and the polishing pad 131 itself have no problem, a wear amount at a portion of the dress board 205 being in contact with the polishing pad 131 all the time and a wear amount at the rest portions of the dress board may become different.

Figure 22:
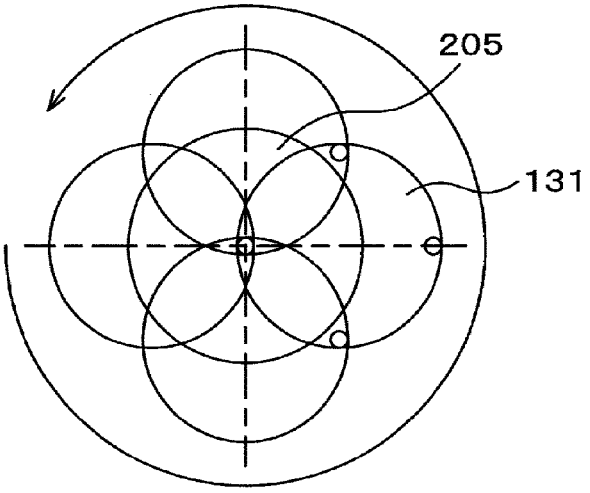
FIG. 22 is a diagram illustrating a state in which the dressing processing on a polishing pad is performed as the polishing pad is revolved.

In consideration of this problem, as shown in FIG. 22, the polishing pad 131 itself may not be rotated on its axis, and the dressing may be performed by bringing the polishing pad 131 into contact with the dress board 205 while allowing the polishing pad 131 to revolve around a position other than the center of the polishing pad 131. That is, the dressing may be performed by a so-called revolution type dressing method where the polishing pad 131 is revolved with respect to the dress board 205.

Accordingly, the dressing can be performed in the state that the polishing pad 131 is in contact with the entire surface of the dress board 205, and, as a result, non-uniform abrasion of the dress board 205 can be suppressed, so that the dress board 205 can be effectively used to the end. In such revolution, by setting a radius of the revolution to allow any positions of the polishing pad 131 to be in contact with the dress board 205 during the revolution, the dressing of the polishing pad 131 can be performed uniformly.

Figure 23:
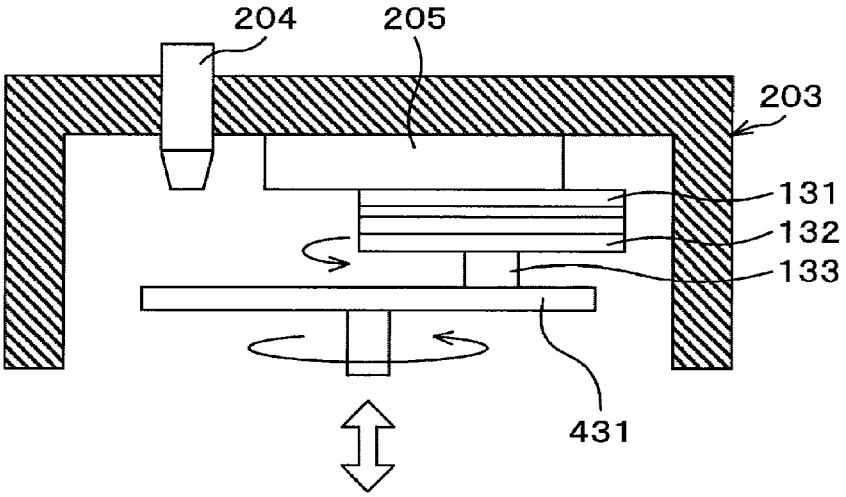
FIG. 23 is a side view schematically illustrating the inside of a dressing apparatus having a function of revolving the polishing pad.

As an example apparatus configured to perform this so-called revolution type dressing, as shown in FIG. 23, the supporting column 133 configured to support the polishing pad 131 may be supported by a supporting body 431 configured to be revolved, and the polishing pad 131 may be revolved within the bus member 203.

Even when this revolution type dressing is performed, the polishing pad 131 itself may be rotated.

Figure 24:
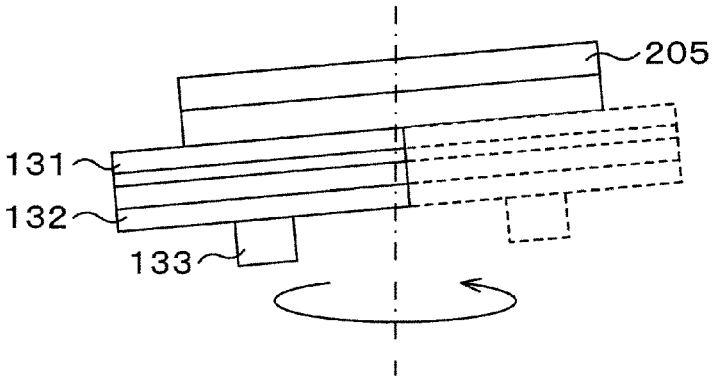
FIG. 24 is a diagram showing a follow-up property of the dress board during the revolution of the polishing pad in a configuration where the dress board is provided by using a universal joint.

Furthermore, even when the revolution type dressing is adopted, the dress board 205 may be provided at the ceiling plate 201 of the bus member 203 with the universal joint 401 therebetween, as stated above. With this configuration, as shown in FIG. 24, even if the polishing pad 131 is inclined when it is revolved, the dress board 205 may also be inclined following the polishing pad 131, so that the bottom surface of the dress board 205 can be made to be contact with the polishing pad 131 all the time.

From the foregoing, it will be appreciated that the exemplary embodiment of the present disclosure has been described herein for purposes of illustration, and that various modifications may be made without departing from the scope and spirit of the present disclosure. Accordingly, the embodiment disclosed herein is not intended to be limiting. The scope of the inventive concept is defined by the following claims and their equivalents rather than by the detailed description of the exemplary embodiment. It shall be understood that all modifications and embodiments conceived from the meaning and scope of the claims and their equivalents are included in the scope of the inventive concept.

INDUSTRIAL APPLICABILITY

The present disclosure has advantages when it is applied to dressing of a polishing member configured to polish a rear surface of a wafer.

We claim:

1. A dressing apparatus of a substrate rear surface polishing member configured to perform dressing of the polishing member configured to polish a rear surface of a substrate, the dressing apparatus of the substrate rear surface polishing member comprising:

a bus member which is equipped with a ceiling plate and a circular or polygonal cylindrical skirt portion provided at a bottom surface of the ceiling plate and which is configured to accommodate the polishing member from thereabove;

a nozzle provided at the bus member and configured to jet a cleaning liquid and a gas onto a polishing surface of the polishing member accommodated in the bus member; and a dressing member provided at the bus member and configured to come into contact with the polishing surface of the polishing member accommodated in the bus member, wherein the dressing apparatus is provided at a position where the dressing apparatus does not overlap with the substrate as a polishing target, when viewed from the top.

2. The dressing apparatus of the substrate rear surface polishing member of claim 1, further comprising:

a nozzle configured to supply a rinse liquid onto the polishing surface of the polishing member.

3. The dressing apparatus of the substrate rear surface polishing member of claim 1, wherein a lower end of the skirt portion is located under a surface of the substrate as the polishing target.

4. The dressing apparatus of the substrate rear surface polishing member of claim 1, wherein the dressing member has a planar shape at a side of the polishing surface of the polishing member, and has a shape covering at least a half of the polishing member.

5. The dressing apparatus of the substrate rear surface polishing member of claim 1, wherein the dressing member is configured to be rotated.

6. The dressing apparatus of the substrate rear surface polishing member of claim 1, wherein the dressing member has a columnar shape and is disposed such that a circumferential surface of the dressing member is configured to be contacted with the polishing surface of the polishing member, and the dressing member is configured to be rotated following up a rotation of the polishing member.

7. The dressing apparatus of the substrate rear surface polishing member of claim 6, wherein the dressing member has a taper shape having different diameters at one end and the other end thereof.

8. The dressing apparatus of the substrate rear surface polishing member of claim 6, wherein the dressing member is configured to be rocked centering on a preset supporting point other than an end portion thereof in a lengthwise direction.

9. The dressing apparatus of the substrate rear surface polishing member of claim 1, wherein the dressing member is provided at the bus member with an elastic member therebetween.

10. The dressing apparatus of the substrate rear surface polishing member of claim 1, wherein the dressing member is provided at the bus member with a universal joint therebetween.

11. The dressing apparatus of the substrate rear surface polishing member of claim 1, wherein the cleaning liquid is heated.

12. The dressing apparatus of the substrate rear surface polishing member of claim 1, further comprising:

an imaging device configured to check the polishing surface of the polishing member.

13. A dressing method of a substrate rear surface polishing member for performing cleaning and dressing of the polishing member by using a dressing apparatus as claimed in claim 12, wherein the cleaning and the dressing are performed based on a surface state of the polishing surface of the polishing member obtained by the imaging device.

14. The dressing apparatus of the substrate rear surface polishing member of claim 1, further comprising:

a laser displacement meter configured to check a surface state of the polishing surface of the polishing member.

15. A dressing method of a substrate rear surface polishing member for performing dressing of the polishing member configured to polish a rear surface of a substrate, the dressing method of the substrate rear surface polishing member comprising:

by using a bus member which is equipped with a ceiling plate and a circular or polygonal cylindrical skirt portion provided at a bottom surface of the ceiling plate and which is configured to accommodate the polishing member from thereabove, at a position where the polishing member does not overlap with a substrate as a polishing target when viewed from the top, performing cleaning by supplying a cleaning liquid onto a polishing surface of the polishing member while rotating the polishing member within the bus member, and performing dressing by bringing a dressing member provided at the bus member into contact with the polishing surface of the polishing member while rotating the polishing member.

16. A dressing method of a substrate rear surface polishing member for performing dressing of the polishing member configured to polish a rear surface of a substrate, the dressing method of the substrate rear surface polishing member comprising:

by using a bus member which is equipped with a ceiling plate and a circular or polygonal cylindrical skirt portion provided at a bottom surface of the ceiling plate and which is configured to accommodate the polishing member from thereabove, at a position where the polishing member does not overlap with a substrate as a polishing target when viewed from the top, performing cleaning by supplying a cleaning liquid onto a polishing surface of the polishing member within the bus member, and performing dressing by bringing a dressing member provided at the bus member into contact with the polishing surface of the polishing member while allowing the polishing member to revolve centering on a position other than a center of the polishing member.

17. The dressing method of the substrate rear surface polishing member of claim 15, wherein a pressing pressure of the polishing member against the rear surface of the substrate while the rear surface of the substrate is polished is adjusted within the bus member.

18. The dressing method of the substrate rear surface polishing member of claim 16, wherein a pressing pressure of the polishing member against the rear surface of the substrate while the rear surface of the substrate is polished is adjusted within the bus member.

* * * * *